US006267662B1

(12) United States Patent
Jard et al.

(10) Patent No.: US 6,267,662 B1
(45) Date of Patent: Jul. 31, 2001

(54) MEASURING A STACK OF COINS IN A COIN HANDLING DEVICE

(75) Inventors: Philippe S. Jard, Downingtown; Philip R. Reger, Newtown Square, both of PA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/548,378

(22) Filed: Apr. 12, 2000

Related U.S. Application Data

(60) Provisional application No. 60/129,059, filed on Apr. 13, 1999.

(51) Int. Cl.[7] ..... G07D 9/00
(52) U.S. Cl. ..... 453/17
(58) Field of Search ..... 453/17; 194/317

(56) References Cited

U.S. PATENT DOCUMENTS

| | | | |
|---|---|---|---|
| 3,020,750 | 2/1962 | Briscoe . | |
| 3,163,818 | 12/1964 | Spaven . | |
| 3,235,795 | 2/1966 | Uozumi . | |
| 3,599,771 | 8/1971 | Hinterstocker . | |
| 3,805,160 | 4/1974 | Philbrick et al. . | |
| 3,901,368 | 8/1975 | Klinger . | |
| 3,963,035 | 6/1976 | Levasseur . | |
| 4,124,111 | 11/1978 | Hayashi . | |
| 4,254,857 | 3/1981 | Levasseur et al. . | |
| 4,460,003 | 7/1984 | Barnes et al. | 453/17 |
| 4,462,512 | 7/1984 | Schuller . | |
| 4,491,140 | 1/1985 | Eglise et al. . | |
| 4,587,984 | 5/1986 | Levasseur et al. . | |
| 5,687,829 * | 11/1997 | Churchman | 194/317 |
| 5,947,257 * | 9/1999 | Schwartz | 453/17 |
| 6,039,166 * | 3/2000 | Abe et al. | 194/317 |
| 6,056,104 * | 5/2000 | Neubarth et al. | 194/317 |
| 6,145,646 * | 11/2000 | Seitz et al. | 194/317 |

FOREIGN PATENT DOCUMENTS

| | | |
|---|---|---|
| 951403 | 7/1974 | (CA) . |
| 35 43 186 A1 | 11/1987 | (DE) . |
| 38 02 121 A1 | 3/1989 | (DE) . |

OTHER PUBLICATIONS

Digital Q Meter QDM, News from Rhode and Schwartz, vol. 10, No. 45, pp. 20–22, 1970.

Carniol, B., Die–Mebgroben–Trennung bei der Induktiven Dickenmessung mit Dampfungsauswertung von Eigenschwingungen, Messtechnik, pp. 284–289 (12/71) (with translation).

* cited by examiner

*Primary Examiner*—Robert P. Olszewski
*Assistant Examiner*—Bryan Jaketic
(74) *Attorney, Agent, or Firm*—Fish & Richardson P.C.

(57) ABSTRACT

A coin handling apparatus includes a coin storage container having conductive electrodes disposed along sides of the coin storage container. The coin handling apparatus also includes a voltage generator. A processor controls the voltage generator to provide output signals to excite the electrodes at multiple frequencies. The processor is configured to determine a resonant frequency based on levels of reflected power resulting from the output signals and to estimate a number of coins in the container based on the resonant frequency.

20 Claims, 7 Drawing Sheets

MEASURING A STACK OF COINS IN A COIN HANDLING DEVICE

CROSS-REFERENCE TO RELATED APPLICATIONS

This application claims the priority of U.S. Provisional Application Ser. No. 60/129,059, filed Apr. 13, 1999.

BACKGROUND

The present invention relates generally to measuring a stack of coins in a coin handling device.

In the field of coin handling devices, the presence of coins in the device are sensed for a variety of purposes. For example, the number of coins in a coin storage tube can be monitored. Such monitoring allows determinations of the change-making capability of the coin handling device to be made and can be used to determine whether a coin received by the device should be routed to a storage tube or to a cashbox. Thus, when the number of coins in a coin tube becomes too few for change-making purposes, an exact change light can be turned on. When a coin tube becomes full, jamming of the coin path can be reduced by diverting coins directly to the cashbox rather than allowing them to pass to the coin tube.

For some purposes, it is sufficient to provide the coin handling device with the capability of detecting whether the level of coins in each coin tube is below a first low level or above a second high level. The low level can serve to indicate whether the coin tube is substantially empty, whereas the high level can serve to indicate whether the coin tube is substantially full. Various sensors have been devised to detect whether the height of a coin stack in a tube is higher or lower than some discrete level. Such sensors include electromechanical switches, as well as optical or inductive devices. Thus, for example, one sensor can be placed near the top of a coin tube and another sensor can be placed near the bottom of the coin tube.

Although such coin tube sensors can provide an indication of whether the height of a coin stack in a tube has reached one or more discrete levels, they generally are less useful for providing a continuous indication of the actual height of the coin stack or the number of coins. In some applications, however, it is desirable to have a more precise and accurate count of the number of coins in each tube to allow improved auditing and to provide greater flexibility in change-making algorithms.

SUMMARY

According to one aspect, a method of determining the number of coins in a coin storage container associated with a coin handling apparatus includes providing output signals to excite a transmission line at multiple frequencies, wherein the transmission line includes conductive electrodes disposed along sides of the storage container storing one or more coins. A resonant frequency of the transmission line is determined based on levels of reflected power resulting from the output signals. A processor associated with the coin handling apparatus estimates the number of coins in the coin storage container based on the resonant frequency.

In various implementations, one or more of the following features may be present. For example, the transmission line can be excited at a series of frequencies. The difference between each frequency in the series and the next frequency in the series can differ by the same frequency. In some embodiments, at least one frequency in the series can correspond to a situation in which the storage container contains a single coin. At least one other frequency can correspond, for example, to a situation in which the storage container is substantially filled with coins. If the storage container is partially filled with coins, then the resonant frequency can fall between maximum and minimum frequencies in the series.

The method can include determining a shift in the resonant frequency, and estimating the number of coins in the coin storage container can be based on the shift in resonant frequency. In some implementations, estimating the number of coins in the coin storage container can include looking up a value stored in memory based on the shift in resonant frequency. In other implementations, estimating the number of coins in the coin storage container can include using a polynomial function to calculate the number of coins as a function of the resonant frequency.

According to another aspect, a coin handling apparatus includes a coin storage container having conductive electrodes disposed along sides of the coin storage container. The coin handling apparatus includes a voltage generator. A processor controls the voltage generator to provide output signals to excite a transmission line that includes the electrodes at multiple frequencies. The processor is configured to determine a resonant frequency based on levels of reflected power resulting from the output signals and to estimate a number of coins in the container based on the resonant frequency.

In some implementations, the electrodes extend along substantially the entire length of the sides of the coin storage container. The conductive electrodes can be buried within the sides of the coin storage container or they can be attached to an outer surface of the coin storage container.

In various implementations, the voltage generator can be arranged to drive the electrodes directly. Alternatively, the voltage generator can be arranged to drive the electrodes through coils. In yet other situations, the voltage generator can be arranged to be coupled directly or capacitively to a coin in the coin storage container.

The processor can be configured to perform various functions described above. For example, the processor can be configured to determine a shift in the resonant frequency and to estimate the number of coins in the coin storage container based on the shift in resonant frequency.

In a further aspect, a coin handling apparatus includes an opening for receiving coins inserted into the coin mechanism, a coin validator including one or more sensors for determining the authenticity and denomination of an inserted coin, and storage containers for storing coins accepted by the coin mechanism. Each storage container can include conductive electrodes disposed along sides of the container. The coin handling apparatus includes a voltage generator and a processor for controlling the voltage generator to provide output signals to excite a transmission line that includes the electrodes at multiple frequencies. The processor is configured to determine a resonant frequency based on levels of reflected power resulting from the output signals and to estimate a number of coins in a particular one of the coin storage containers based on the resonant frequency.

In some implementations, the techniques described here can facilitate determining a more precise and accurate count of the number of coins in the coin storage containers to allow improved auditing and to provide greater flexibility in change-making algorithms.

Other features and advantages will be apparent from the detailed description, the accompanying drawings and the claims.

DETAILED DESCRIPTION

Figure 1:
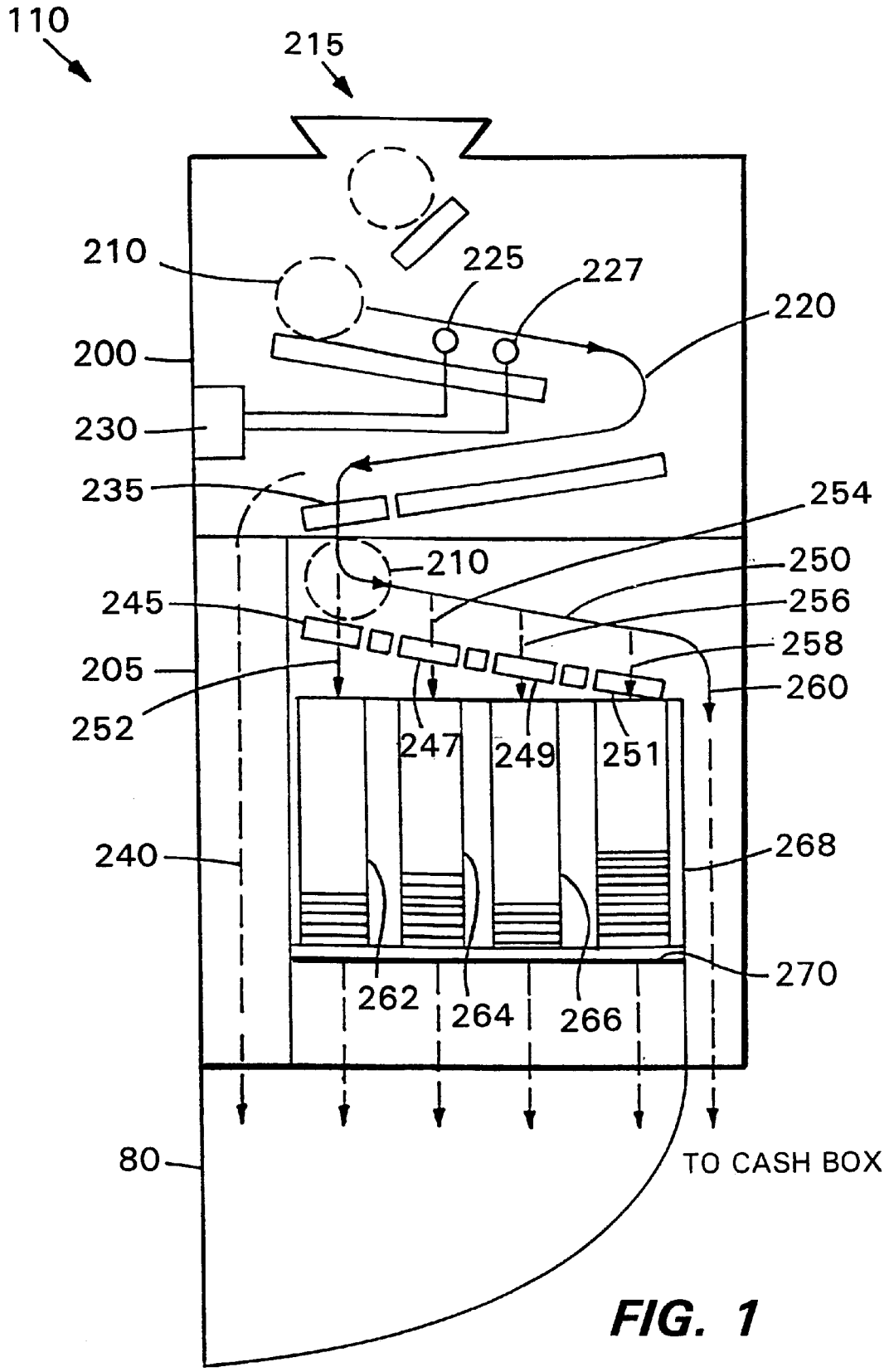
FIG. 1 illustrates an exemplary coin handling apparatus.

Referring to FIG. 1, an exemplary coin handling apparatus 110 includes a coin validator 200 and a coin separator 205. The coin validator 200 receives inserted coins 210 through an opening 215. The coin travels along a path 220 in the coin validator 200 past sensors 225, 227. The sensors 225, 227 generate electrical signals which are provided to a coin mechanism controller 230 having control circuitry, including a microprocessor or micro-controller. The electrical signals generated by the sensors 225, 227 contain information corresponding to the measured characteristics of the coin, such as the coin's diameter, thickness, metal content and electromagnetic properties. Based on these electrical signals, the controller 230 is able to determine whether the coin is acceptable, and if so, the denomination of the coin 210.

If the coin 210 is unacceptable, the coin mechanism controller 230 controls a gate 235 to direct the unacceptable coin 210 to a reject chute 240. In contrast, if the coin 210 is acceptable, it is directed to the coin separator 205 by the gate 235. The coin separator has multiple gates 245, 247, 249 and 251, also controlled by signals from the controller 230, for diverting the coin 210 from a main path 250. The coin 210 can be diverted into respective paths 252, 254, 256 and 258, or the coin 210 can be allowed to proceed along the path main 250 to a path 260 leading to the cash box 120.

Each of the paths 252, 254, 256 and 258 leads to a respective one of four plastic coin tubes or containers 262, 264, 266 and 268. Each coin tube 262–268 is arranged to store a vertical stack of coins of a particular denomination which can be recognized and accepted by the coin mechanism 110. Thus, for example, in one implementation, the coin tubes 262, 264, 266 and 268 store U.S. nickels, dimes, quarters and one-dollar coins, respectively. Although four coin tubes are shown in FIG. 1, any number can be provided.

A dispenser 270 associated with the coin tubes 262–268 is operable to dispense coins from the tubes when change is to be given by the coin mechanism 110.

Figure 2:
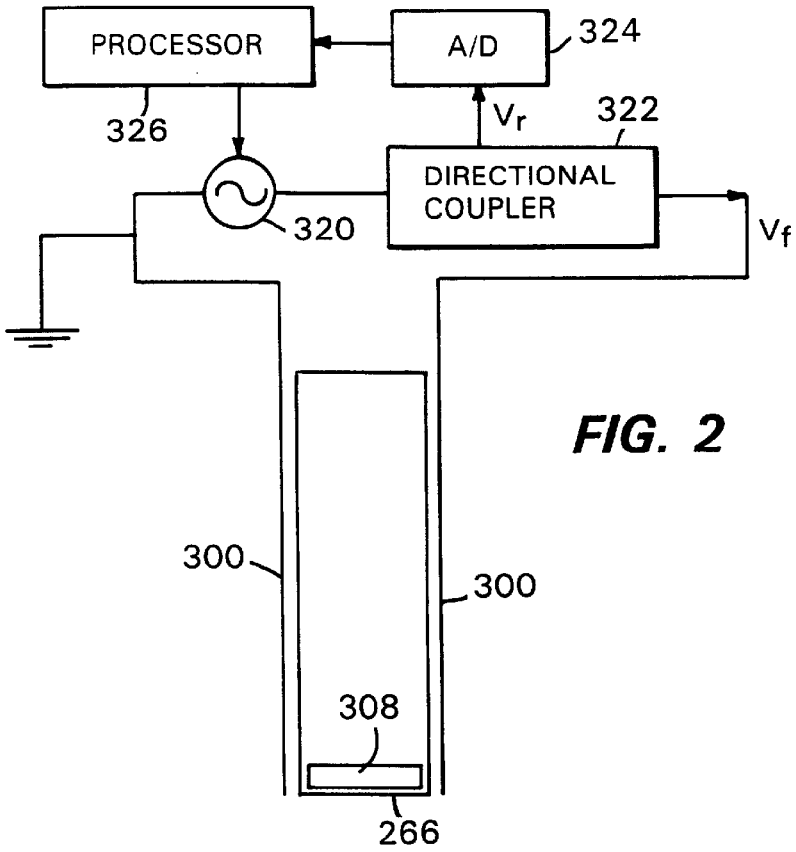
FIG. 2 illustrates a coin storage container forming a transmission line according to one embodiment of the invention.

As shown in FIG. 2, each of the coin tubes, such as the coin tube 266, is designed to act as a transmission line by providing a pair of conductive strips 300 along opposite outer surfaces of the coin tube. The conductive strips 300 serve as electrodes. In one implementation, the conductive strips 300 include adhesive copper foil, although other conductive materials also can be used. In general, the electrode strips 300 are disposed along the sides of the storage tube 266 and can be buried within the sides of the tube or attached to the outer surface of the tube. Preferably, the conductive strips 300 extend along substantially the entire length of the tube 266.

The introduction of one or more coins 308 into the tube 266 changes the resonant frequency of the transmission line comprising the tube 266 and the conductive strips 300. In general, the greater the number of coins introduced into the tube 266, the greater the frequency shift. Thus, a measurement or determination of the resonant frequency of the transmission line comprising the tube 266, the conductive strips 300 and the coins 308, if any, can provide an indication of the number of coins in the tube 266. More specifically, a determination of the resonant frequency shift can provide an indication of the height of the coin stack in the tube 266 as well as the number of coins in the tube.

Figure 3:
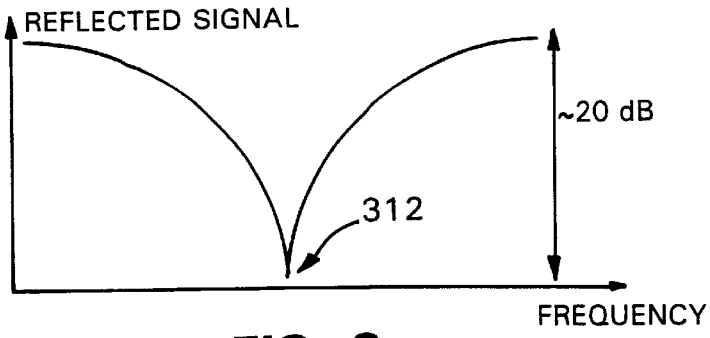
FIG. 3 is a graph showing generally how, in one embodiment, the reflected signal of the transmission line changes with changing frequency.

One technique for determining the resonant frequency is to measure the reflected wave at an output of a di-rectional coupler 322 coupled, for example, in series with the transmission line and to determine the frequency which shows a minimum (or maximum) level 312 of absorption (FIG. 3). The frequency which exhibits the minimum (or maximum) level 312 of absorption corresponds to the resonant frequency.

Figure 9:
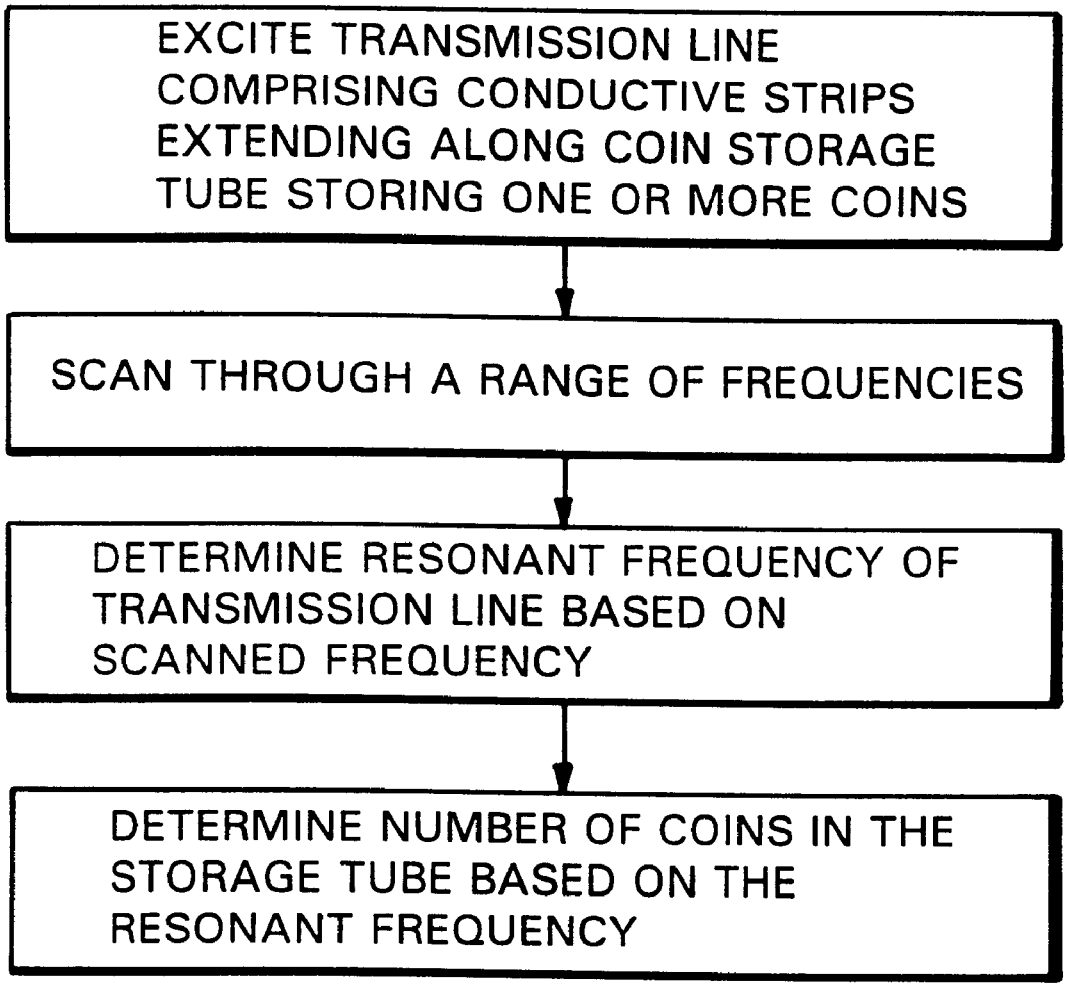
FIG. 9 is a flow chart of a method according to the invention.

A flow chart illustrating the general operation of the coin handling apparatus is shown in FIG. 9. A high frequency voltage generator 320 can be electrically coupled to the strips 300 to excite the transmission line by applying a voltage at a series of discrete frequencies. For example, the frequency of the applied voltage can be increased from a minimum frequency to a maximum frequency in predetermined frequency steps. In general, the voltage generator 320 scans through a predetermined range of frequencies by varying the frequency by some predetermined amount each time the frequency of the applied voltage is changed. In one implementation, the maximum and minimum frequencies provided by the voltage generator 320 correspond to the situation in which the coin tube 266 contains only a single coin and the situation in which the coin tube is full, respectively. In other words, if the tube 266 is full, the minimum frequency output by the voltage generator 320 should be the resonant frequency. Conversely, if the tube 266 contains only a single coin, the maximum frequency output by the generator 320 will be the resonant frequency. If the tube 266 is partially full, then the resonant frequency will fall somewhere between the minimum and maximum frequencies.

A processor 326 such as a central processing unit (CPU) controls the output of the voltage generator 320, and the directional coupler 322 transfers forward power ($V_f$) to the electrodes 300. Reflected power ($V_r$) is transferred to an analog-to-digital (A/D) converter 324. Digitally converted signals from the A/D converter 324 are passed to the processor 326 which is programmed to determine the resonant frequency, the height of the coin stack, and the number of coins in the tube.

In one implementation, copper foil adhesive strips, having a width of about 2.54 centimeters (cm), were placed on two side of a U.S. quarter size coin tube associated with a Cashflow™ type of coin changer available from Mars Electronic International, Inc. Each copper strip had an inductance of about 27.54 nano-henries (nH) when measured at approximately 40 megahertz (MHz). The material of the coin tube was GE Lexan 241 which has a dielectric constant of about 2.96 at 1 MHz. The thickness of the coin tube was 2.54 millimeters (mm), with an inner tube diameter of about 24.4 mm and an outer tube diameter of about 30.48 mm. Exemplary values of the resonant frequency are in the range of about 0.1 gigahertz (GHz) to several GHz. Shifts in the resonant frequency of up to several MHz can be obtained for each coin added.

The number of coins corresponding to various shifts in the resonant frequency for a particular configuration can be obtained experimentally and stored, for example, in memory associated with the processor 326. In other words, the memory can store a look-up table that includes the correspondence between a measured resonant frequency and the number of coins in the tube. In other implementations, the processor 326 uses a polynomial function to calculate the number of coins as a function of frequency.

Figure 4:
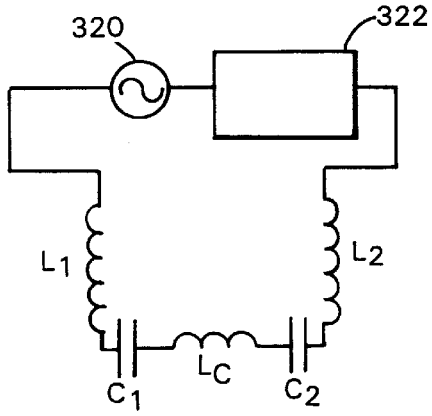
FIG. 4 is a simplified model circuit of the transmission line of FIG. 2.

The configuration illustrated in FIG. 2 can be modelled using the simplified circuit shown in FIG. 4, in which $L_1$ and $L_2$ each represent the inductance of one of the strips 300, $L_c$ represents the inductance of the coins in the tube 266, and $C_1$ and $C_2$ each represent the capacitance between the coin and the tube. For the configuration illustrated in FIG. 2, $L_1$ equals $L_2$, and $C_1$ equals $C_2$. The total complex impedance $Z_T$ seen from the voltage generator 320 with a single coin in the tube 266 is the sum of the impedance of the coin ($Z_C$) and the impedance of the conductive strips ($Z_L$) In other words, $$Z_T=Z_C+Z_L,$$

where $Z_c=(1/jwC_{eq})+jwL_c$, with $C_{eq}=C_1C_2/(C_1+C_2)$, and $Z_L=jwL_T$, with $L_T=2L$.

As coins are added to the tube 266, the individual impedances of the coins are in parallel and reduce the effective inductive length of the strips 300. For n coins, the impedance is $Z_C(n)=Z_C/n$. Similarly, assuming that the inductance $L_C$ is linearly distributed with n coins stacked in a coin tube having a maximum capacity of N coins, the inductance $L_T(n)=(L_T/N)\ (N-n)$.

Using the simplified model above, the resonant frequency, as a function of the number of coins in the tube 66, is given by $$f_0(n)=2\pi[nC_{eq}(L_C/n+L_T(N-n)/N)]^{-1/2}.$$

The capacitances $C_1$ and $C_2$ can be estimated by considering the strip and the edge of the coin to be the capacitor electrodes. Thus, the capacitances can be approximated by $$C_1=C_2=\epsilon_0\epsilon_r A/d,$$

where A represents the surface area of the strip 300 facing the edge of the coin, d is the distance between the strip and the edge of the coin, and $\epsilon_r$ is the dielectric constant the tube.

Various modifications can be made. For example, an inductor having substantially the same value as the inductance of the strip 300 can be added in series to the strip to provide a more monotonic output from the directional coupler 322.

Figure 5A:
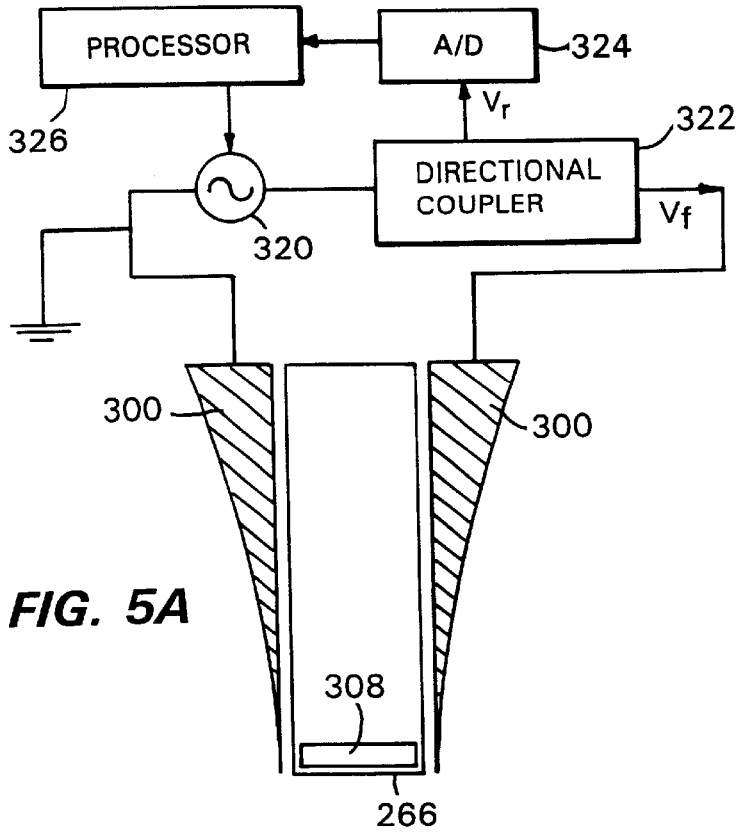
FIG. 5A and 5B illustrate coin storage containers with electrodes formed by curved conductive strips according to the invention.
Figure 5B:
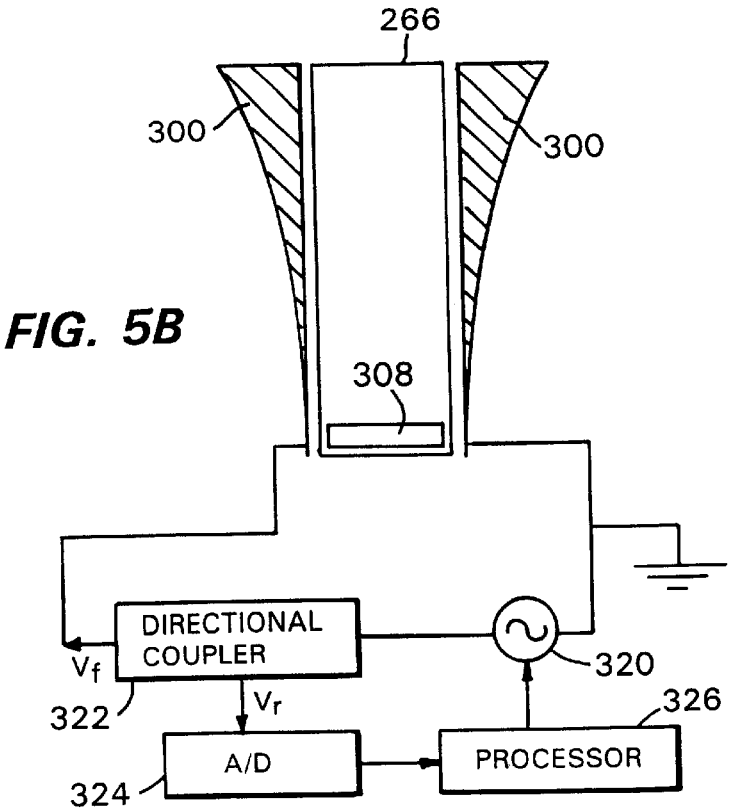

In other implementations, the flat rectangular-shaped strips 300 of FIG. 2 can be replaced by conductive electrodes having a curved shape along a surface facing away from the coin tube 266 (FIG. 5A, 5B). Such curve-shaped electrodes 300 can improve the resolution as the number of coins increases. For example, the outer surface of the electrodes 300 can have a substantially exponential shape. The generator 320 can be coupled to either the wider or the thinner ends of the electrodes 300.

Figure 6:
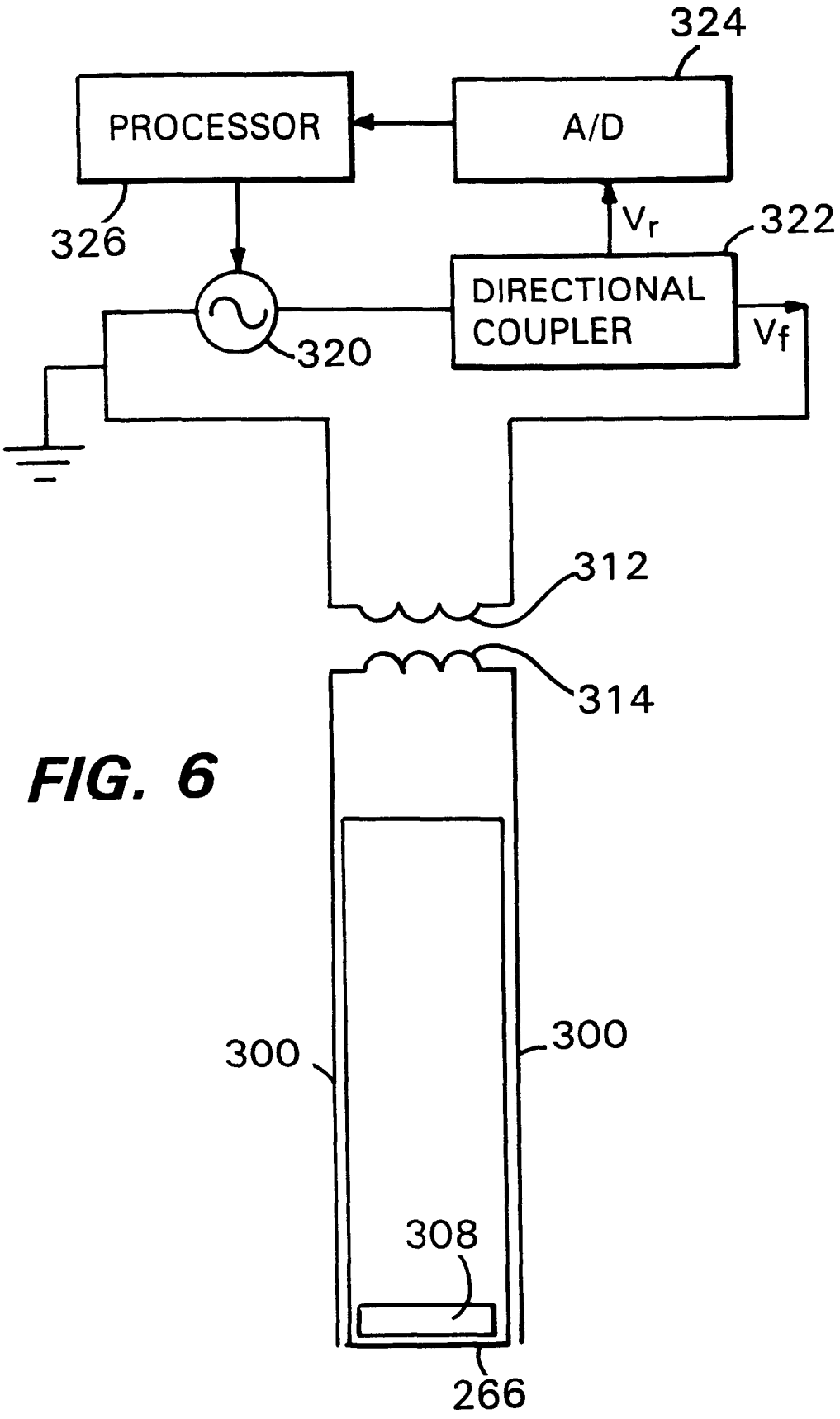
FIGS. 6, 7A and 7B illustrate further arrangements for exciting the transmission line associated with a coin storage container according to the invention.

Instead of driving the electrode strips 300 directly, a balun arrangement including, for example, two coils 312, 314 (FIG. 6) can be used to drive the electrodes from the top of the tube 266. Such an arrangement can help reduce the sensitivity of the circuit to external influences and noise.

Figure 7B:
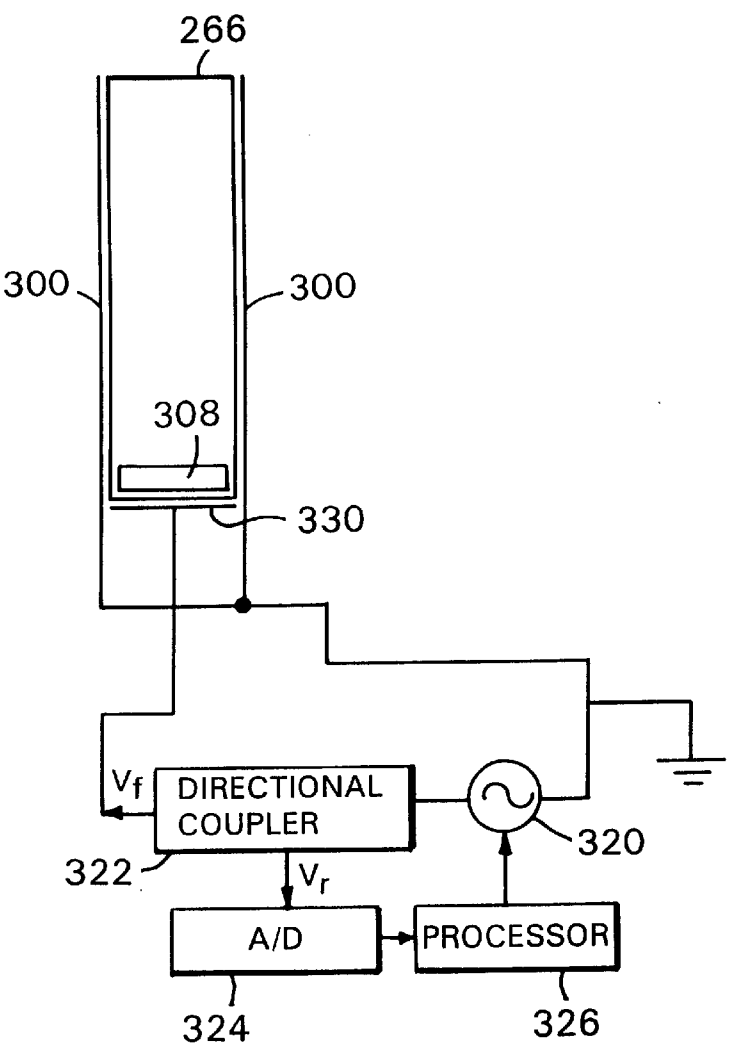
Figure 7A:
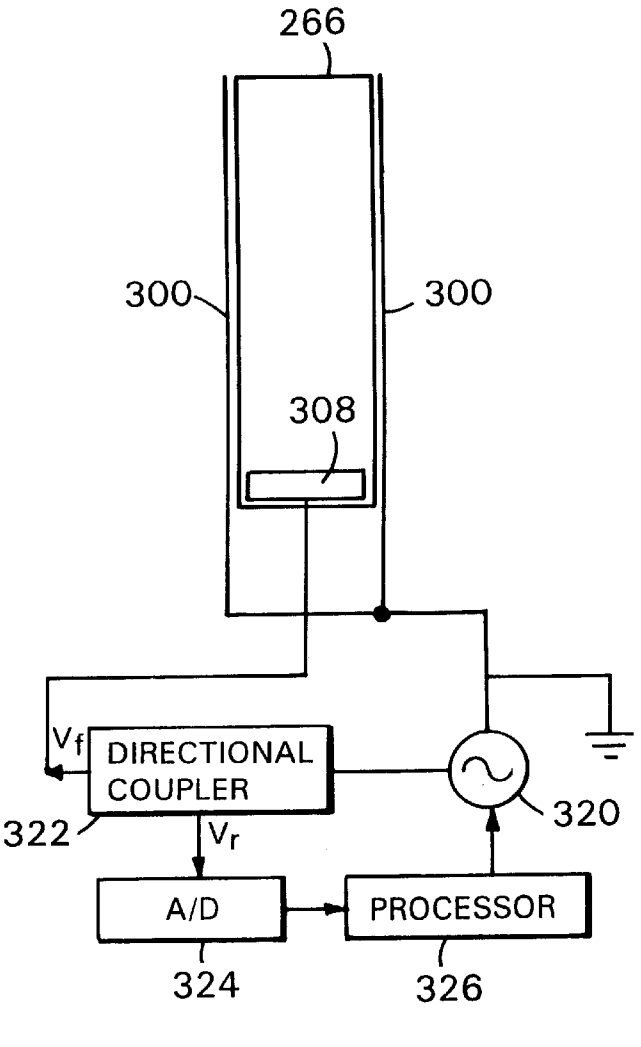

According to yet another implementation, the transmission line comprising the conductive strips 300 can be driven via a coin 308 at the bottom of the tube 266 with the capacitive electrodes 300 connected to ground. The voltage generator 320 can be coupled directly to the coin 308 (FIG. 7A). Alternatively, the generator 320 can be coupled capacitively to the coin 308 (FIG. 7B). In the arrangement of FIG. 7B using capacitive coupling to the coin 308, an electrode 330 formed, for example, of adhesive copper foil or other conductive materials, is provided along the bottom of the tube 266. The forward power ($V_f$) from the directional coupler 322 is coupled to the coin 308 via the bottom electrode 330. Using the arrangements of FIGS. 7A and 7B can allow the electrode strips 300 to act as shields, thereby reducing the amount of interaction with adjacent coin tubes. Downward shifts of more than 10 MHz have been observed in the resonant frequency as U.S. quarters were added to the coin tube.

Figure 8:
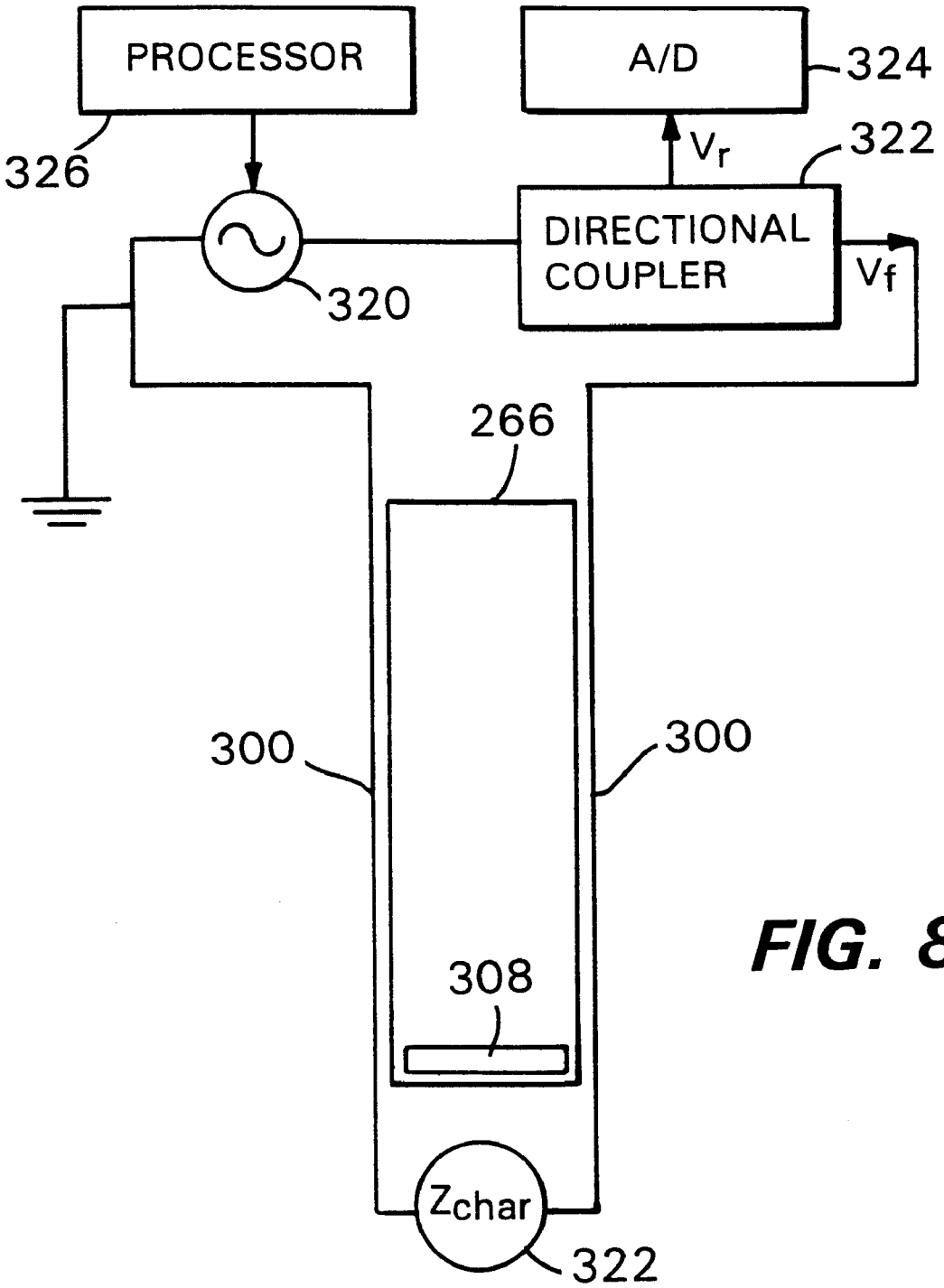
FIG. 8 illustrates a further embodiment of a coin storage container according to the invention.

In yet a further embodiment, the transmission line is terminated by an impedance ($Z_{char}$) which is substantially equal to the characteristic impedance of the transmission line (FIG. 8). In such an implementation, there would be substantially no reflected power unless one or more coins are stored in the tube 266. The disturbance caused by coin(s) in the tube would be measured by the processor 326 which would provide an indication of the number of coins based on the measured disturbance.

Preferably, a single voltage generator, directional coupler and processor are associated with all the coin tubes. For example, the voltage generator can be selectively coupled to one coin tube at a time. The height of the coin stack and the corresponding number of coins in each tube would, thus, be determined in succession. Alternatively, the respective coin tube transmission lines can be designed so that the range of possible resonant frequencies associated with each coin tube does not overlap the corresponding ranges of the other coin tubes. In that way, the voltage generator can be coupled to each of the coin tubes at the same time and a determination of the number of coins in the various storage tubes can be performed in parallel.

Other implementations are within the scope of the claims.

What is claimed is:

1. A method of determining the number of coins in a coin storage container associated with a coin handling apparatus, the method comprising:

providing output signals to excite a transmission line at a plurality of frequencies, wherein the transmission line includes conductive electrodes disposed along sides of the storage container having a number of coins stored therein;

determining a resonant frequency of the transmission line based on levels of reflected power resulting from the output signals;

estimating, in a processor associated with the coin handling apparatus, the number of coins in the coin storage container based on the resonant frequency.

2. The method of claim 1 wherein the transmission line is excited at a series of frequencies, wherein a difference between each frequency in the series to the next frequency in the series differs by the same frequency.

3. The method of claim 1 wherein the transmission line is excited at a series of frequencies, and wherein at least one frequency in the series corresponds to a situation in which the storage container contains a single coin.

4. The method of claim 1 wherein the transmission line is excited at a series of frequencies, and wherein at least one other frequency corresponds to a situation in which the storage container is substantially filled with coins.

5. The method of claim 1 wherein the transmission line is excited at a series of frequencies, and wherein if the storage container is partially filled with coins, then the resonant frequency falls between maximum and minimum frequencies in the series.

6. The method of claim 1 including determining a shift in the resonant frequency, wherein estimating the number of coins in the coin storage container is based on the shift in resonant frequency.

7. The method of claim 6 wherein estimating the number of coins in the coin storage container includes looking up a value stored in memory based on the shift in resonant frequency.

8. The method of claim 1 wherein estimating the number of coins in the coin storage container includes using a polynomial function to calculate the number of coins as a function of the resonant frequency.

9. A coin handling apparatus comprising:

a coin storage container having conductive electrodes disposed along sides of the coin storage container;

a voltage generator; and a processor to control the voltage generator to provide output signals to excite a transmission line that includes the electrodes at a plurality of frequencies;

wherein the processor is configured to determine a resonant frequency based on levels of reflected power resulting from the output signals and to estimate a number of coins in the container based on the resonant frequency.

10. The coin handling apparatus of claim 9 wherein the electrodes extend along substantially the entire length of the sides of the coin storage container.

11. The coin handling apparatus of claim 9 wherein the conductive electrodes are buried within the sides of the coin storage container.

12. The coin handling apparatus of claim 9 wherein the conductive electrodes are attached to an outer surface of the coin storage container.

13. The coin handling apparatus of claim 9 wherein the voltage generator is arranged to drive the electrodes directly.

14. The coin handling apparatus of claim 9 wherein the voltage generator is arranged to drive the electrodes through a plurality of coils.

15. The coin handling apparatus of claim 9 wherein the voltage generator is arranged to be coupled capacitively to a coin in the coin storage container.

16. The coin handling apparatus of claim 9 wherein the voltage generator is arranged to be coupled directly to a coin in the coin storage container.

17. The coin handling apparatus of claim 9 wherein the processor is configured to determine a shift in the resonant frequency and to estimate the number of coins in the coin storage container based on the shift in resonant frequency.

18. A coin handling apparatus comprising:

an opening for receiving coins inserted into the coin mechanism;

a coin validator including one or more sensors for determining the authenticity and denomination of an inserted coin; and a plurality of storage containers for storing coins accepted by the coin mechanism, wherein each storage container includes conductive electrodes disposed along sides of the container;

a voltage generator; and a processor for controlling the voltage generator to provide output signals to excite a transmission line that includes the electrodes at a plurality of frequencies;

wherein the processor is configured to determine a resonant frequency based on levels of reflected power resulting from the output signals and to estimate a number of coins in a particular one of the coin storage containers based on the resonant frequency.

19. The coin handling apparatus of claim 18 wherein the processor is configured to determine a shift in the resonant frequency and to estimate the number of coins in the particular coin storage container based on the shift in resonant frequency.

20. The coin handling apparatus of claim 18 wherein the electrodes disposed along the sides of a given coin storage container extend substantially along the entire length of the coin storage container.

* * * * *